US010920352B2

(12) United States Patent
Denning et al.

(10) Patent No.: US 10,920,352 B2
(45) Date of Patent: Feb. 16, 2021

(54) DUAL-CONFIGURATION FABRIC FRAME FOR A MANEUVERABLE SEWING MACHINE

(71) Applicant: HANDI QUILTER, INC., North Salt Lake, UT (US)

(72) Inventors: Darren Denning, Sandy, UT (US); Gordon Hudson, North Salt Lake, UT (US); Gary J. Konzak, Salem, UT (US); Cathie Zimmerman, Sandy, UT (US)

(73) Assignee: HANDI QUILTER, INC., North Salt Lake, UT (US)

( * ) Notice: Subject to any disclaimer, the term of this patent is extended or adjusted under 35 U.S.C. 154(b) by 262 days.

(21) Appl. No.: 16/190,605

(22) Filed: Nov. 14, 2018

(65) Prior Publication Data

US 2020/0149201 A1 May 14, 2020

(51) Int. Cl.
*D05B 39/00* (2006.01)

(52) U.S. Cl.
CPC ..... *D05B 39/005* (2013.01)

(58) Field of Classification Search
CPC ..... D05B 39/005; D05B 11/00
See application file for complete search history.

(56) References Cited

U.S. PATENT DOCUMENTS 2,236,421 A 3/1941 Boettcher
4,192,241 A 3/1980 Reed et al.
4,411,208 A 10/1983 Nashida et al.
4,834,006 A 5/1989 Goto
4,969,410 A 11/1990 Brower et al.
5,018,460 A 5/1991 Schilling et al.
5,040,473 A 8/1991 Zesch
5,287,820 A 2/1994 Stutznacker
5,540,165 A 7/1996 Katou
5,860,375 A 1/1999 Williams
5,913,275 A 6/1999 Flynn
(Continued)

FOREIGN PATENT DOCUMENTS

WO 2003008356 A2 1/2003

OTHER PUBLICATIONS

"Home Sewing Machines & Embroidery Machines", http://www.brother-usa.com/homesewing/new-for-2016/, Brother Website last accessed Oct. 20, 2015.

(Continued)

*Primary Examiner* — Tajash D Patel
(74) *Attorney, Agent, or Firm* — Maschoff Brennan

(57) ABSTRACT

Dual-configuration fabric frame for a maneuverable sewing machine. In some embodiments, a dual-configuration fabric frame for a maneuverable sewing machine may include a left side rail, a right side rail, a front rail, a rear rail, a quilt-backing pole including a ratchet mechanism, a take-up pole including a ratchet mechanism, a hoop frame configuration, and a suspension frame configuration. The hoop frame configuration may support a relatively wide fabric clamped thereto that flows from inside boundaries of a working area to outside the boundaries of the working area. The suspension frame configuration may support a relatively narrow fabric that flows from being spooled on the quilt-backing pole, through the working area, to being spooled on the take-up pole.

22 Claims, 4 Drawing Sheets

(56) References Cited

U.S. PATENT DOCUMENTS

| | | | | |
|---|---|---|---|---|
| 6,079,341 | A | 6/2000 | Resta | |
| 6,615,756 | B2 | 9/2003 | Barrus | |
| 6,631,688 | B1 | 10/2003 | Maag | |
| 6,792,884 | B1 | 9/2004 | Barrus et al. | |
| 6,860,211 | B2 | 3/2005 | Valeriote | |
| 6,883,446 | B2 | 4/2005 | Koerner | |
| 6,990,914 | B2 | 1/2006 | Canan | |
| 7,011,031 | B1 | 3/2006 | Bradley | |
| 7,207,281 | B1 | 4/2007 | Kasa | |
| 7,584,709 | B2 | 9/2009 | Nakatsu et al. | |
| 9,109,313 | B2 * | 8/2015 | Bagley | D05B 35/04 |
| 9,145,630 | B2 | 9/2015 | McCoy | |
| 9,476,151 | B2 | 10/2016 | Bagley | |
| 2003/0200906 | A1 | 10/2003 | Maag | |
| 2012/0318181 | A1 | 12/2012 | Kasa | |
| 2014/0251193 | A1 * | 9/2014 | Resta | D05B 39/00 112/475.08 |
| 2017/0107652 | A1 | 4/2017 | McKinney | |

OTHER PUBLICATIONS

"Dime: Designs in Machine Embroidery", http://www.shop.dzgns.com/products/shorte, dime Website last accessed.

"Q Snap", http://www.qsnap.com/, Q Snap Website last accessed Oct. 20, 2015.

"Ikan", http://ikancorp.com/productdetail.php?id=346#tab, ikan Website last accessed Oct. 20, 2015.

"Introducing THE Dream Fabric Frame", https://www.youtube.com/watch?v=PVXbm6M684Q&feature=youtu.be, Published Aug. 8, 2015, BrotherSews video last accessed Oct. 20, 2015.

"Fabric Set-Up and Management on THE Dream Fabric Frame", https://www.youtube.com/watch?v=46MJS7-IzFE, Published Aug. 8, 2015, BrotherSews video last accessed Oct. 20, 2015.

Bagley, Jim M., Gracewood, Inc., Brother Dream Fabric Frame Assembly Instructions, 22 pages, accessed Feb. 7, 2017 at http://www.google.com/url?sa=t&rct=j&q=&esrc=s&source=web&cd=2&cad=rja&uact=8&ved=0ahUKEwjE9MyfkP_RAhXjx1QKHUhZBxUQFgguMAE&url=http%3A%2F%2Fwww.allbrands.com%Fimages2%Fcommon%2Fpdfs%2FBrother%2520Dream%2520Fabric%2520Frame%2520Instructions%252015-11-04.

*Handi Quilter, Inc.* v. *Gracewood Management, Inc.*, Civil Case No. 2:16-cv-01101, Civil Cover Sheet filed Oct. 26, 2016.

*Handi Quilter, Inc.* v. *Gracewood Management, Inc.*, Civil Case No. 2:16-cv-01101, Complaint for Declaratory Judgment of Noninfringement filed Oct. 26, 2016.

*Handi Quilter, Inc.* v. *Gracewood Management, Inc.*, Civil Case No. 2:16-cv-01101, Report on the filing or Determination of an Action filed Oct. 27, 2016.

*Handi Quilter, Inc.* v. *Gracewood Management, Inc.*, Civil Case No. 2:16-cv-01101, Acceptance of Service filed Nov. 2, 2016.

*Handi Quilter, Inc.* v. *Gracewood Management, Inc.*, Civil Case No. 2:16-cv-01101, Defendant's Answer and Counterclaim (Jury Demand Relied Upon) filed Nov. 23, 2016.

*Handi Quilter, Inc.* v. *Gracewood Management, Inc.*, Civil Case No. 2:16-cv-01101, Defendant's Notice of Appearance of J. David Nelson filed Nov. 23, 2016.

*Handi Quilter, Inc.* v. *Gracewood Management, Inc.*, Civil Case No. 2:16-cv-01101, Defendant's Notice of Appearance of Robert D. Dahle filed Nov. 23, 2016.

*Handi Quilter, Inc.* v. *Gracewood Management, Inc.*, Civil Case No. 2:16-cv-01101, Notice of Assignment to a U.S. Magistrate Judge filed Nov. 28, 2016.

*Handi Quilter, Inc.* v. *Gracewood Management, Inc.*, Civil Case No. 2:16-cv-01101, Notice of Alternative Dispute Resolution Program filed Nov. 28, 2016.

*Handi Quilter, Inc.* v. *Gracewood Management, Inc.*, Civil Case No. 2:16-cv-01101, Notice from the Court re: Initial Scheduling filed Nov. 28, 2016.

*Handi Quilter, Inc.* v. *Gracewood Management, Inc.*, Civil Case No. 2:16-cv-01101, Notice from the Court re: Initial PreTrial Conference filed Dec. 1, 2016.

*Handi Quilter, Inc.* v. *Gracewood Management, Inc.*, Civil Case No. 2:16-cv-01101, Defendant's Motion for Pro Hac Vice Admission and Consent of James K. Cleland filed Dec. 6, 2016.

*Handi Quilter, Inc.* v. *Gracewood Management, Inc.*, Civil Case No. 2:16-cv-01101, Order Granting Pro Hac Vice Admission of James K. Cleland filed Dec. 6, 2016.

*Handi Quilter, Inc.* v. *Gracewood Management, Inc.*, Civil Case No. 2:16-cv-01101, Defendant's Consent/Reassignment to U.S. Magistrate Form filed Dec. 8, 2016.

*Handi Quilter, Inc.* v. *Gracewood Management, Inc.*, Civil Case No. 2:16-cv-01101, Plaintiff's Consent/Reassignment to U.S. Magistrate Form filed Dec. 14, 2016.

*Handi Quilter, Inc.* v. *Gracewood Management, Inc.*, Civil Case No. 2:16-cv-01101, Plaintiff's Answer to Counterclaim filed Dec. 14, 2016.

*Handi Quilter, Inc.* v. *Gracewood Management, Inc.*, Civil Case No. 2:16-cv-01101, Plaintiff's Motion to Dismiss Defendant's Claim for Pre-Issuance Damages Under 35 U.S.C. § 154(d) filed Dec. 14, 2016.

*Handi Quilter, Inc.* v. *Gracewood Management, Inc.*, Civil Case No. 2:16-cv-01101, Plaintiff's First Amended Complaint for Declaratory Judgment of NonInfringement and Invalidity (Jury Demanded) filed Dec. 14, 2016.

*Handi Quilter, Inc.* v. *Gracewood Management, Inc.*, Civil Case No. 2:16-cv-01101, Plaintiff's Corporate Disclosure Statement filed Dec. 21, 2016.

*Handi Quilter, Inc.* v. *Gracewood Management, Inc.*, Civil Case No. 2:16-cv-01101, Defendant's Certificate of Service of Local Patent Rule 2.1 Accused Instrumentality Disclosures filed Dec. 21, 2016.

*Handi Quilter, Inc.* v. *Gracewood Management, Inc.*, Civil Case No. 2:16-cv-01101, Defendant's Disclosure under Rule 7.1 of the Federal Rules of Procedure filed Dec. 23, 2016.

*Handi Quilter, Inc.* v. *Gracewood Management, Inc.*, Civil Case No. 2:16-cv-01101, Defendant's Answer to Amended Complaint and Counterclaim filed Dec. 28, 2016.

*Handi Quilter, Inc.* v. *Gracewood Management, Inc*, Civil Case No. 2:16-cv-01101, Plaintiff's Answer to Counterclaim filed Dec. 29, 2016.

*Handi Quilter, Inc.* v. *Gracewood Management, Inc.*, Civil Case No. 2:16-cv-01101, Plaintiff's Notice of Appearance of Counsel of Daniel R. Barber filed Dec. 30, 2016.

*Handi Quilter, Inc.* v. *Gracewood Management, Inc.*, Civil Case No. 2:16-cv-01101, Defendant's Certificate of Service of Fed. R. Civ. Pro. 26(a)(1) and LPR 2.2 Initial Disclosures filed Jan. 4, 2017.

*Handi Quilter, Inc.* v. *Gracewood Management, Inc.*, Civil Case No. 2:16-cv-01101, Plaintiff's Motion for Judgment on the Pleadings as to Defendant's claim for PreIssuance Damages Under 35 U.S.C.§ 154(d) filed Jan. 10, 2017.

*Handi Quilter, Inc.* v. *Gracewood Management, Inc.*, Civil Case No. 2:16-cv-01101, Stipulated Attorneys' Planning Meeting Report filed Jan. 18, 2017.

*Handi Quilter, Inc.* v. *Gracewood Management, Inc.*, Civil Case No. 2:16-cv-01101, Joint Motion for Protective Order filed Jan. 26, 2017.

*Handi Quilter, Inc.* v. *Gracewood Management, Inc.*, Civil Case No. 2:16-cv-01101, Protective Order filed Jan. 27, 2017.

*Handi Quilter, Inc.* v. *Gracewood Management, Inc.*, Civil Case No. 2:16-cv-01101, Patent Scheduling Order and Order Vacating Hearing filed Jan. 27, 2017.

*Handi Quilter, Inc.* v. *Gracewood Management, Inc.*, Civil Case No. 2:16-cv-01101, Defendant's Fed.R.Civ.P. 26(A)(1)(A)(i) and LPR 2.2 Initial Disclosures dated Jan. 4, 2017.

*Handi Quilter, Inc.* v. *Gracewood Management, Inc.*, Civil Case No. 2:16-cv-01101, Plaintiff's Rule 26(A)(1)(A)(i) and Local Patent Rule 2.2 Initial Disclosures dated Jan. 11, 2017.

*Handi Quilter, Inc.* v. *Gracewood Management, Inc.*, Civil Case No. 2:16-cv-01101, Plaintiff Handi Quilter, Inc.'s Rule 26(a)(1)(A)(i) and Local Patent Rule 2.2 Initial Disclosures, filed Jan. 11, 2017.

(56) References Cited

OTHER PUBLICATIONS

*Handi Quilter, Inc.* v. *Gracewood Management, Inc.*, Civil Case No. 2:16-cv-01101, Plaintiff Handi Quilter, Inc.'s First Set of Requests for Production of Documents and Things Nos. 1-2, filed Jan. 11, 2017.

*Handi Quilter, Inc.* v. *Gracewood Management, Inc.*, Civil Case No. 2:16-cv-01101, Defendant Gracewood Management, Inc., Objections and Responses to Plaintiff Handi Quilter, Inc.'s First set of Requests for Production of Documents and Things Nos. 1-2, filed Feb. 10, 2017.

*Handi Quilter, Inc.* v. *Gracewood Management, Inc.*, Civil Case No. 2:16-cv-01101, Gracewood Management, Inc.'s First Set of Requests for Production of Documents Nos. 1-61 to Handi Quilter, Inc., filed Jan. 26, 2017.

*Handi Quilter, Inc.* v. *Gracewood Management, Inc.*, Civil Case No. 2:16-cv-01101, Plaintiff Handi Quilter, Inc.'s Responses and Objections to Defendant's First Set of Requests for Production of Documents Nos. 1-61, filed Feb. 27, 2017.

*Handi Quilter, Inc.* v. *Gracewood Management, Inc.*, Civil Case No. 2:16-cv-01101, Gracewood Management, Inc.'s First Set of Interrogatories Nos. 1-6 to Handi Quilter, Inc., filed Jan. 26, 2017.

*Handi Quilter, Inc.* v. *Gracewood Management, Inc.*, Civil Case No. 2:16-cv-01101, Plaintiff Handi Quilter, Inc.'s Responses and Objections to Defendant's First Set of Interrogatories Nos. 1-6, filed Feb. 27, 2017.

*Handi Quilter, Inc.* v. *Gracewood Management, Inc.*, Civil Case No. 2:16-cv-01101, Plaintiff Handi Quilter, Inc.'s First Set of Interrogatories Nos. 1-14, filed Feb. 27, 2017.

*Handi Quilter, Inc.* v. *Gracewood Management, Inc.*, Civil Case No. 2:16-cv-01101, Gracewood Management, Inc.'s Objections and Responses to Handi Quilter, Inc.'s First Set of Interrogatories Nos. 1-14, filed.

*Handi Quilter, Inc.* v. *Gracewood Management, Inc.*, Civil Case No. 2:16-cv-01101, Gracewood Management, Inc.'s Verified Response to Handi Quilter, Inc.'s First Set of Interrogatories Nos. 1-14, Feb. 27, 2017.

*Handi Quilter, Inc.* v. *Gracewood Management, Inc.*, Civil Case No. 2:16-cv-01101, Gracewood Management, Inc.'s Verified First Supplemental Responses to Handi Quilter, Inc.'s First Set of Interrogatories Nos. 1-14, filed Feb. 27, 2017.

*Handi Quilter, Inc.* v. *Gracewood Management, Inc.*, Civil Case No. 2:16-cv-01101, Plaintiff Handi Quilter, Inc.'s Second Set of Requests for Production of Documents and Things Nos. 3-23, filed Feb. 27, 2017.

*Handi Quilter, Inc.* v. *Gracewood Management, Inc.*, Civil Case No. 2:16-cv-01101, Gracewood Management, Inc.'s Objections and Responses to Handi Quilter, Inc.'s Second Set of Requests for Production of Documents and Things Nos. 3-23, filed Feb. 27, 2017.

*Handi Quilter, Inc.* v. *Gracewood Management, Inc.*, Civil Case No. 2:16-cv-01101, Plaintiff Handi Quilter, Inc.'s Second Set of Interrogatories No. 15, filed Feb. 7, 2017.

*Handi Quilter, Inc.* v. *Gracewood Management, Inc*, Civil Case No. 2:16-cv-01101, Gracewood Management, Inc.'s Objections and Responses to Handi Quilter, Inc.'s Second Set of Interrogatories No. 15, filed Mar. 8, 2017.

*Handi Quilter, Inc.* v. *Gracewood Management, Inc.*, Civil Case No. 2:16-cv-01101, Gracewood Management, Inc.'s Verified Responses to Handi Quilter, Inc.'s Second Set of Interrogatories No. 15, filed Mar. 8, 2017.

*Handi Quilter, Inc.* v. *Gracewood Management, Inc.*, Civil Case No. 2:16-cv-01101, Plaintiff Handi Quilter, Inc.'s Third Set of Request for Production of Documents and Things Nos. 24-25, filed Feb. 6, 2017.

*Handi Quilter, Inc.* v. *Gracewood Management, Inc.*, Civil Case No. 2:16-cv-01101, Gracewood Management, Inc.'s Objections and Responses to Handi Quilter, Inc.'s Third Set of Requests for Production of Documents and Things Nos. 24-25, filed Mar. 8, 2017.

*Handi Quilter, Inc.* v. *Gracewood Management, Inc.*, Civil Case No. 2:16-cv-01101, Defendant and Counterclaim Plaintiff Gracewood Management, Inc.'s Initial Infringement Contentions, filed Feb. 15, 2017.

*Handi Quilter, Inc.* v. *Gracewood Management, Inc.*, Civil Case No. 2:16-cv-01101, Plaintiff Handi Quilter, Inc.'s LPR 2.4 Initial Noninfringement, Unenforceability and Invalidity Contentions, filed Mar. 1, 2017.

*Handi Quilter, Inc.* v. *Gracewood Management, Inc.*, Civil Case No. 2:16-cv-01101, Plaintiff Handi Quilter, Inc.'s Revised LPR 2.4 Initial Noninfringement, Unenforceability and Invalidity Contentions, filed Mar. 27, 2017.

*Handi Quilter, Inc.* v. *Gracewood Management, Inc.*, Civil Case No. 2:16-cv-01101, Gracewood Management, Inc.'s Second Set of Requests for Production of Documents Nos. 62-63 to Handi Quilter, Inc., filed Mar. 27, 2017.

*Handi Quilter, Inc.* v. *Gracewood Management, Inc.*, Civil Case No. 2:16-cv-01101, Gracewood Management, Inc.'s Second Set of Interrogatories Nos. 17-18 to Handi Quilter, Inc filed Mar. 27, 2017.

*Handi Quilter, Inc.* v. *Gracewood Management, Inc.*, Civil Case No. 2:16-cv-01101, Plaintiff Handi Quilter, Inc.'s Fourth Set of Request for Production of Documents and Things Nos. 26-44 filed Mar. 30, 2017.

*Handi Quilter, Inc.* v. *Gracewood Management, Inc.*, Civil Case No. 2:16-cv-01101, Plaintiff Handi Quilter, Inc.'s Third Set of Interrogatories Nos. 16, filed Mar. 30, 2017.

*Handi Quilter, Inc.* v. *Gracewood Management, Inc.*, Civil Case No. 2:16-cv-01101, Gracewood's Disclosure under Rule 7.1 of Federal Rules of Civil Procedure, filed Dec. 23, 2016.

*Handi Quilter, Inc.* v. *Gracewood Management, Inc.*, Civil Case No. 2:16-cv-01101, Defendant's Answer to Amended Complaint and Counterclaim, (Jury Demand Relied Upon), filed Dec. 28, 2016.

*Handi Quilter, Inc.* v. *Gracewood Management, Inc.*, Civil Case No. 2:16-cv-01101, Plaintiff's Answer to Counterclaim Jury Demanded, filed Dec. 29, 2016.

*Handi Quilter, Inc.* v. *Gracewood Management, Inc.*, Civil Case No. 2:16-cv-01101, Plaintiff's Notice of Appearance of Counsel, Daniel R Barber, filed Dec. 30, 2016.

*Handi Quilter, Inc.* v. *Gracewood Management, Inc.*, Civil Case No. 2:16-cv-01101, Defendant's Certificate of Service of Fed.R.CivP. 26(A)(1) and LPR 2.2 Initial Disclosures of Gracewood Management, Inc., filed Jan. 4, 2017.

*Handi Quilter, Inc.* v. *Gracewood Management, Inc.*, Civil Case No. 2:16-cv-01101, Patent Case Scheduling Order ad Order Vacating Hearing, filed Jan. 27, 2017.

*Handi Quilter, Inc.* v. *Gracewood Management, Inc.*, Civil Case No. 2:16-cv-01101, Gracewood Management, Inc.'s Opposition to Plaintiff's Motion for Summary Judgment on the Pleadings as to Defendant's Claim for Pre-Issuance Damages under 35 U.S.C. § 154(d), filed Feb. 7, 2017.

*Handi Quilter, Inc.* v. *Gracewood Management, Inc.*, Civil Case No. 2:16-cv-01101, Gracewood Management, Inc.'s Memorandum in Opposition to Plaintiff's Motion for Summary Judgment on the Pleadings as to Defendant's Claim for Pre-Issuance Damages under 35 U.S.C. § 154(d), filed Feb. 7, 2017.

*Handi Quilter, Inc.* v. *Gracewood Management, Inc.*, Civil Case No. 2:16-cv-01101, Modification of Docket, filed Feb. 8, 2017.

*Handi Quilter, Inc.* v. *Gracewood Management, Inc.*, Civil Case No. 2:16-cv-01101, Memorandum Decision and Order Denying Plaintiff's Motion for Judgment on the Pleadings, filed Mar. 7, 2017.

* cited by examiner

DUAL-CONFIGURATION FABRIC FRAME FOR A MANEUVERABLE SEWING MACHINE

BACKGROUND

Sewing machines generally function by reciprocating a threaded needle into and out of one or more layers of fabric to form a row of stitches in the fabric. While some sewing machines are operated in a stationary fashion while the fabric is repositioned underneath the needle, other sewing machines are operated in a maneuverable fashion by repositioning the needle while the fabric remains stationary. When a sewing machine is operated in this maneuverable fashion, the fabric is typically mounted on a stationary fabric frame.

One difficulty encountered with stationary fabric frames for maneuverable sewing machines is maintaining an adequate tension on the fabric mounted thereon during operation of the sewing machine. Where the tension on the fabric is inadequate, it can be difficult to form even and precisely positioned rows of stitches using the maneuverable sewing machine.

Another difficulty encountered with fabric frames for maneuverable sewing machines is accommodating fabric that is relatively large in a room that is relatively small. For example, maneuverable sewing machines are often used in making quilts. A quilt for a California king-sized bed may be about 8.2 feet wide by about 8.5 feet long. Many fabric frames used in making quilts are designed to have a width that is at least as wide as the width of the fabric of the quilt. Therefore, a fabric frame used to make this quilt for a California king-sized bed may be about 10 feet wide, which would require a relatively large room to accommodate the fabric frame.

The subject matter claimed herein is not limited to embodiments that solve any disadvantages or that operate only in environments such as those described above. Rather, this background is only provided to illustrate one example technology area where some embodiments described herein may be practiced.

SUMMARY

In some embodiments, a dual-configuration fabric frame for a maneuverable sewing machine may include a left side rail, a right side rail, a front rail, a rear rail, a quilt-backing pole including a ratchet mechanism, a take-up pole including a ratchet mechanism, a hoop frame configuration, and a suspension frame configuration. The hoop frame configuration may include the left side rail, the right side rail, the front rail, and the rear rail defining a left side boundary, a right side boundary, a front boundary, and a rear boundary, respectively, of a working area, and the left side rail, the right side rail, the front rail, and the rear rail being configured to support a relatively wide fabric clamped thereto that flows from inside the boundaries of the working area to outside the boundaries of the working area. The suspension frame configuration may include the ratchet mechanisms of the quilt-backing pole and the take-up pole being configured to maintain tension on a relatively narrow fabric that flows from being spooled on the quilt-backing pole, through the working area between the left side boundary and the right side boundary, to being spooled on the take-up pole.

In some embodiments, the left side rail, the right side rail, and the front rail may be fixed in place and may not be configured to rotate.

In some embodiments, the suspension frame configuration may include the ratchet mechanisms of the quilt-backing pole and the take-up pole being configured to maintain tension on the relatively narrow fabric that flows from being spooled on the quilt-backing pole, over the front rail, through the working area between the left side boundary and the right side boundary, and underneath the rear rail, to being spooled on the take-up pole.

In some embodiments, the left side rail, the right side rail, the front rail, and the rear rail may have a smooth, cylindrical outer surface.

In some embodiments, the hoop frame configuration may include the left side rail, the right side rail, the front rail, and the rear rail being configured to support the relatively wide fabric clamped thereto that flows from inside the boundaries of the working area, underneath the rear rail, to outside the rear boundary of the working area.

In some embodiments, the dual-configuration fabric frame may further include a left side clamp permanently connected to the left side rail and a right side clamp permanently connected to the right side rail. In these embodiments, the rear rail may be detachably connectable to the left side rail and the right side rail by clamping the rear rail in the left side clamp and the right side clamp.

In some embodiments, the length of the rear rail may be greater than the length of the front rail, the length of the quilt-backing pole may be greater than the length of the front rail, and/or the length of the take-up pole may be greater than the length of the front rail.

In some embodiments, the left side rail, the right side rail, the front rail, and the rear rail may be configured to rotate.

In some embodiments, the suspension frame configuration may include the ratchet mechanisms of the quilt-backing pole and the take-up pole being configured to maintain tension on the relatively narrow fabric that flows from being spooled on the quilt-backing pole, over the front rail, through the working area between the left side boundary and the right side boundary, and over the rear rail, to being spooled on the take-up pole.

In some embodiments, the left side rail, the right side rail, the front rail, and the rear rail may have a non-cylindrical outer surface.

In some embodiments, upper surfaces of the left side rail, the right side rail, and the front rail may define a plane and the quilt-backing pole may be positioned beneath the plane. In these embodiments, the rear rail and the take-up pole may be positioned above the plane. Alternatively, in these embodiments, an upper surface of the rear rail may further define the plane, and the take-up pole may be positioned below the plane.

It is to be understood that both the foregoing general description and the following detailed description are exemplary and explanatory and are not restrictive of the invention as claimed.

BRIEF DESCRIPTION OF THE DRAWINGS

Example embodiments will be described and explained with additional specificity and detail through the use of the accompanying drawings in which.

DESCRIPTION OF EMBODIMENTS

One difficulty encountered with stationary fabric frames for maneuverable sewing machines is maintaining an adequate tension on the fabric mounted thereon during operation of the sewing machine. While suspension fabric frames generally provide more than adequate tension, these fabric frames tend to be too wide (e.g., 10 feet wide) to fit in the limited available space of a typical room of a home.

The embodiments disclosed herein may provide various benefits. In particular, the embodiments disclosed herein may, for example, provide a dual-configuration fabric frame for a maneuverable sewing machine. The example dual-configuration fabric frame disclosed herein may be configured to maintain an adequate tension on one or more layers of fabric that are mounted on the dual-configuration fabric frame, in either a hoop frame configuration or a suspension frame configuration, to enable formation of even and precisely positioned rows of stitches using the maneuverable sewing machine. For example, the hoop frame configuration may accommodate the mounting of relatively wide fabric, such as fabric for a relatively wide quilt (e.g., a California king-sized quilt), due to the hoop frame configuration being configured to accommodate fabric that is generally wider than the general width of the dual-configuration fabric frame, using clips to provide adequate tension to the fabric. Alternatively, the suspension frame configuration may accommodate the mounting of relatively narrow fabric, such as fabric for a relatively narrow quilt (e.g., a baby crib-sized quilt), due to the suspension frame configuration being configured to accommodate fabric that is generally narrower than the general width of the dual-configuration fabric frame using a quilt-backing pole and a take-up pole that include ratchet mechanisms to provide more than adequate tension to the fabric. Therefore, the example dual-configuration fabric frame disclosed herein may allow, in a single fabric frame, for the mounting of relatively wide fabric with adequate tension or relatively narrow fabric with more than adequate tension (and potentially less basting together of quilt layers). Further, the example dual-configuration fabric frame disclosed herein may be positioned in available space of a typical room of a home that would not accommodate the relatively wider width of a conventional suspension fabric frame.

Figure 1A:
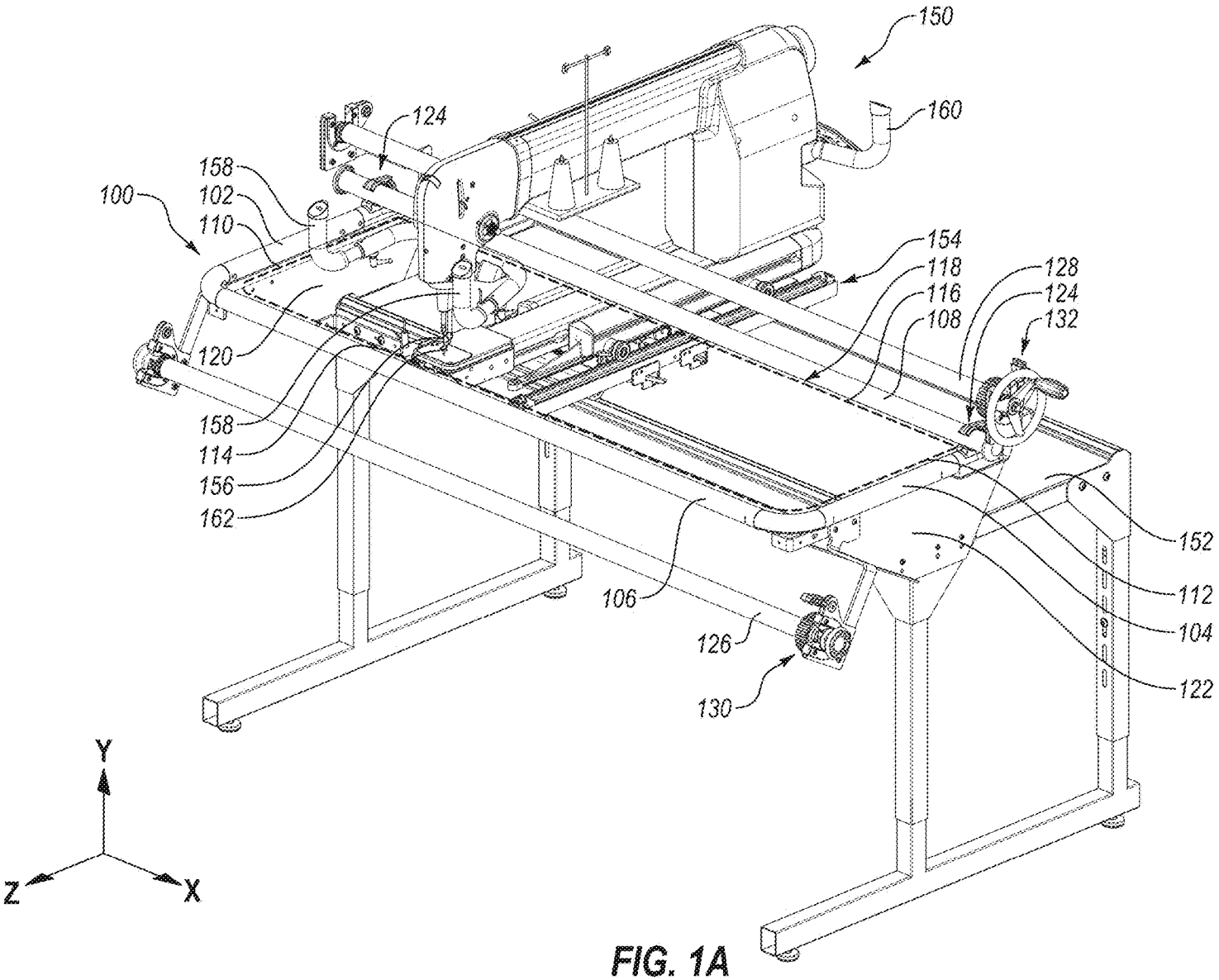
FIG. 1A is a front top perspective view of an example dual-configuration fabric frame for a maneuverable sewing machine.
Figure 1B:
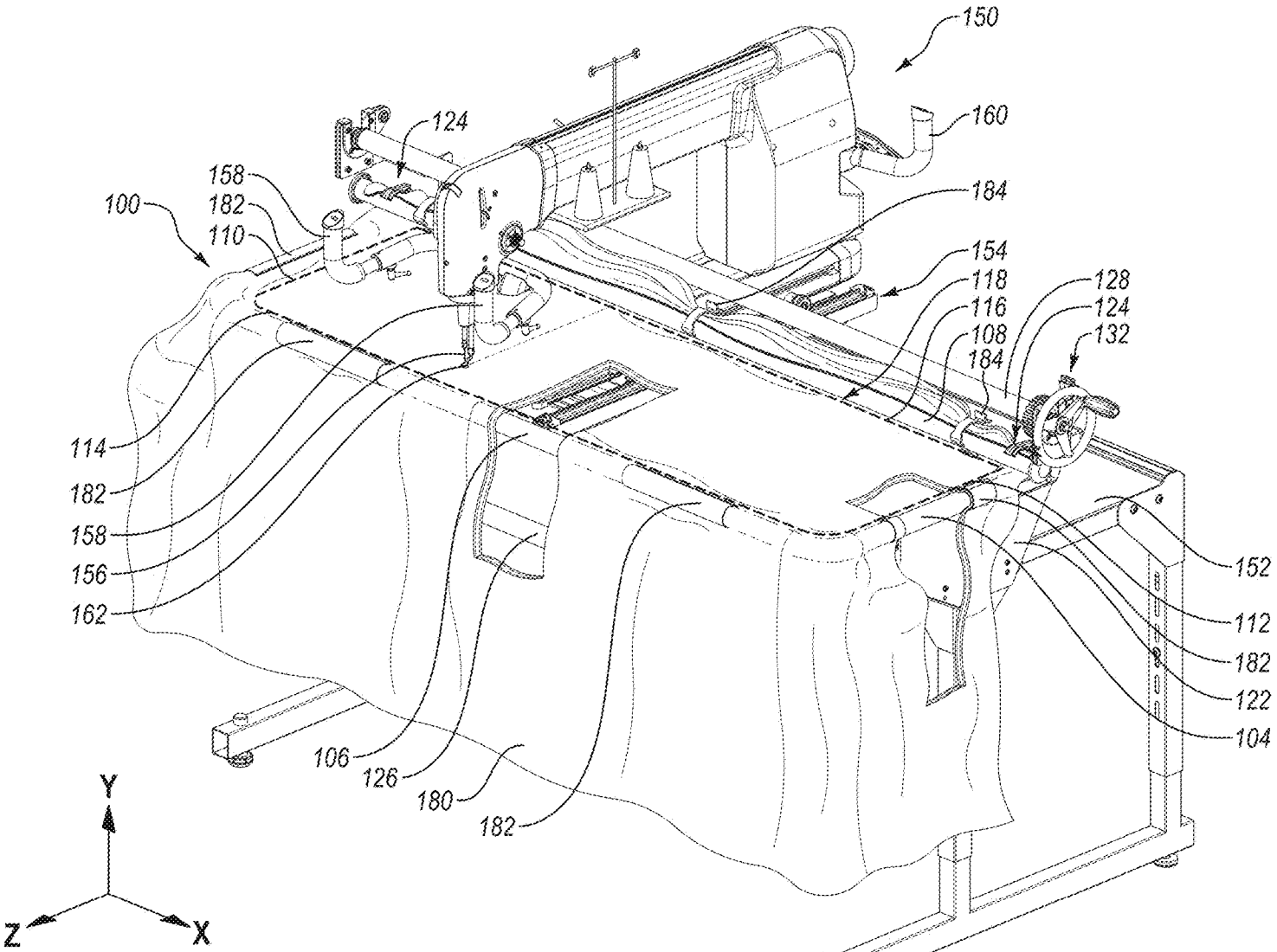
FIG. 1B is a front top perspective view of the example dual-configuration fabric frame of FIG. 1A with a relatively wide fabric mounted thereon in a hoop frame configuration.
Figure 1C:
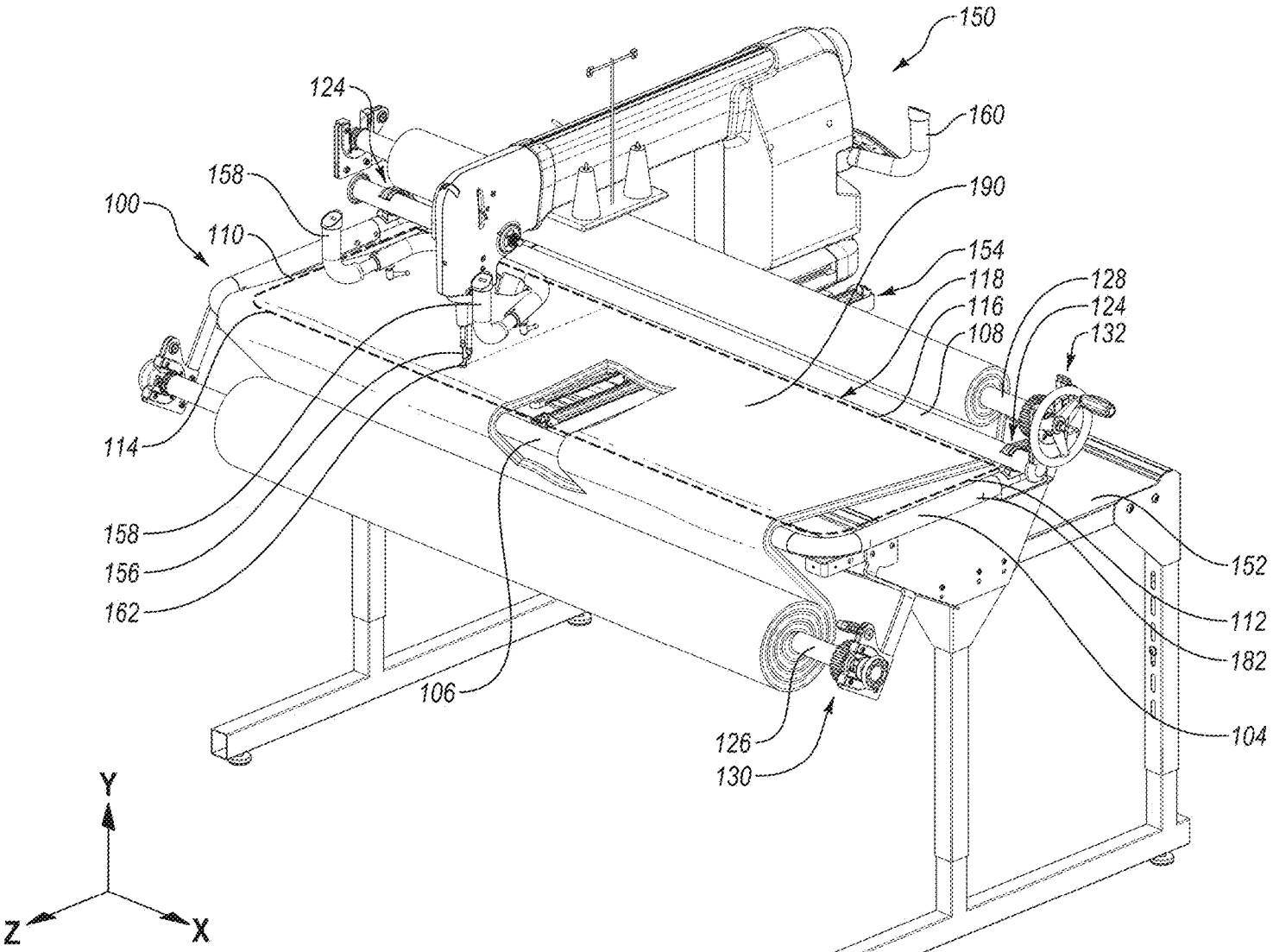
FIG. 1C is a front top perspective view of the example dual-configuration fabric frame of FIG. 1A with a relatively narrow fabric mounted thereon in a suspension frame configuration.
Figure 1D:
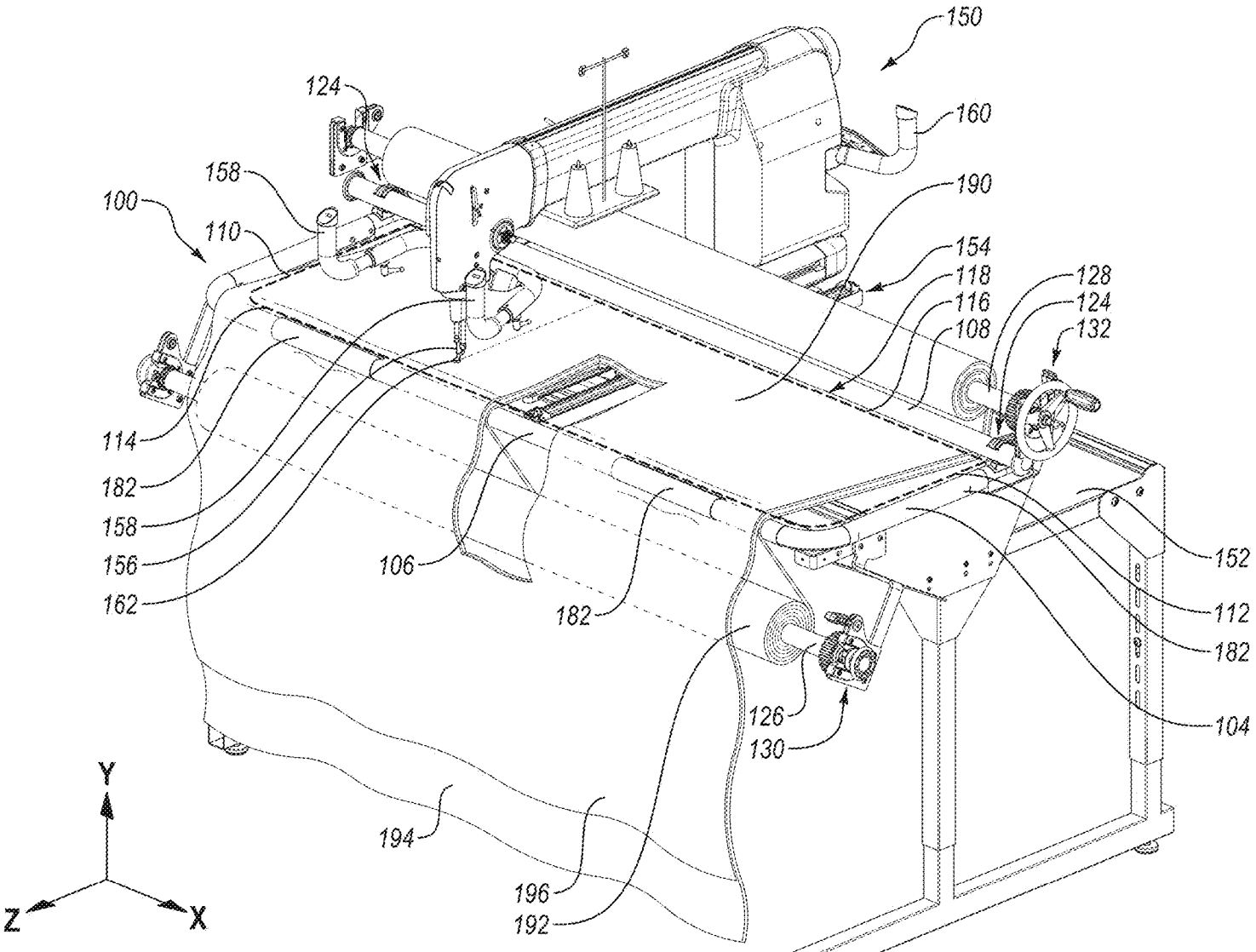
FIG. 1D is a front top perspective view of the example dual-configuration fabric frame of FIG. 1A with a relatively narrow fabric mounted thereon in a suspension frame configuration with "floating" quilt-top and batting layers.

Turning to the figures, FIG. 1A is a front top perspective view of an example dual-configuration fabric frame 100 for a maneuverable sewing machine 150, FIG. 1B is a front top perspective view of the example dual-configuration fabric frame 100 with a relatively wide fabric 180 mounted thereon in a hoop frame configuration, FIG. 1C is a front top perspective view of the example dual-configuration fabric frame 100 with a relatively narrow fabric 190 mounted thereon in a suspension frame configuration, and FIG. 1D is a front top perspective view of the example dual-configuration fabric frame 100 with a relatively narrow fabric 190 mounted thereon in a suspension frame configuration with "floating" quilt-top and batting layers.

The sewing machine 150 of FIGS. 1A-1D is specialized for quilting and is known as a long-arm quilting machine. Some features of a long-arm quilting machine that distinguish it from other types of sewing machines is the "long-arm" configuration of the machine, handlebars (such as handlebars 158 and 160 discussed below), and a hopping foot (such as a hopping foot 162 discussed below). Quilting typically involves stitching together multiple layers of fabric to form a quilt. A quilt typically includes a layer of batting sandwiched in between upper and lower layers of fabric. However, although the sewing machine 150 of FIGS. 1A-1D is a long-arm quilting machine, it is understood that the sewing machine 150 of FIGS. 1A-1D is only one of countless sewing machines in which the fabric frame 100 may be employed. The scope of the fabric frame 100 is therefore not intended to be limited to employment in any particular sewing machine.

As disclosed in FIG. 1A, the fabric frame 100 may include a left side rail 102, a right side rail 104, a front rail 106, and a rear rail 108, which may each have a smooth, cylindrical outer surface. The front rail 106 may be permanently connected to the left side rail 102 and to the right side rail 104, and each of the left side rail 102, right side rail 104, and front rail 106 may be fixed in place and not configured to rotate. In contrast, the rear rail 108 may be detachably connectable to the left side rail 102 and to the right side rail 104 by, for example, clamping the rear rail 108 in a clamp 124 permanently connected to the left side rail 102 and in another clamp 124 permanently connected to the right side rail 104.

Upper surfaces of the left side rail 102, the right side rail 104, and the front rail 106, and a lower surface of the rear rail 108 may define a left side boundary 110, a right side boundary 112, a front boundary 114, and a rear boundary 116, respectively, of a working area 118 for the sewing machine 150. Further, the fabric frame 100 may be supported above a table 152 by a left side riser 120, which connects the table 152 to the left side rail 102, and a right side riser 122, which connects the table 152 to the right side rail 104. The table 152 may also support a carriage assembly 154 to which the sewing machine 150 may be mounted. The carriage assembly 154 may be configured to allow a user to maneuver the sewing machine 150 both laterally (i.e., along the x axis) and longitudinally (i.e., along the z axis), or some combination thereof, with respect to the working area 118 of the fabric frame 100.

As disclosed in FIG. 1B, the fabric frame 100 may be configured to support one or more layers of the fabric 180 mounted thereon in a hoop frame configuration. Unlike other fabric frame configurations that require the width of the fabric frame to be at least as wide as the width of the fabric, the hoop frame configuration of the fabric frame 100 may be configured to support the fabric 180 that is generally wider than the general width of the fabric frame 100. In particular, the left side rail 102, the right side rail 104, the front rail 106, and the rear rail 108 may be configured to support the fabric 180 in such a way that the fabric 180 may flow from inside of the boundaries 110-116 of the working area 118 to outside of the boundaries 110-116 of the working area 118. In particular, the fabric 180 may flow over upper surfaces of the left side rail 102 (see FIG. 1A), the right side rail 104 (see cutaway section in FIG. 1B), and the front rail 106 (see cutaway section in FIG. 1B) from inside the boundaries 110-116 of the working area 118 to outside the left side boundary 110, the right side boundary 112, and the front boundary 114 of the working area 118. At the same time, the rear rail 108 may be configured to support the fabric 180 that may flow underneath the rear rail 108 from inside the boundaries 110-116 of the working area 118 to outside the rear boundary 116 of the working area 118. The flowing of the fabric 180 underneath the rear rail 108, even where the fabric 180 is wider than the fabric frame 100, may be possible due to the detachability of the rear rail 108 from the left side rail 102 and the right side rail 104, which detachability may be enabled by the clamps 124.

With reference to FIGS. 1A and 1B, the fabric 180 may be mounted on the hoop frame configuration of the fabric frame 100 using a variety of mounting methods. One such mounting method may include various steps. For example, the method may include detaching the rear rail 108 from the clamps 124, thereby detaching the rear rail 108 from the fabric frame 100. Next, the method may include draping the fabric 180 over the left side rail 102, the right side rail 104, and the front rail 106. Then, the method may include reconnecting the rear rail 108 by placing the rear rail 108 on top of the fabric 180 (which may involve inserting the rear rail 108 from the side into the throat of the sewing machine 150, and thereby not disturbing a needle 156 or the hopping foot 162 of the sewing machine), partially wrapping the fabric 180 up and around the rear surface of the rear rail 108, and then pushing the rear rail 108 into the clamps 124. Next, the method may include pulling the fabric 180 tight on the fabric frame 100. Then, the method may include clamping the fabric 180 to the left side rail 102, the right side rail 104, and the front rail 106 by placing clamps 182 at various positions along the left side rail 102, the right side rail 104, and the front rail 106 in order to maintain an adequate tension on the fabric 180 during operation of the sewing machine 150. Next, the method may include clamping the portion of the fabric 180 that is positioned near the rear rail 108 to the rear rail 108 using clamps 184, in order to stow this portion of the fabric 180 out of the way of the working area 118 and out of the way of the sewing machine 150. It is noted that this example method of mounting the fabric 180 to the fabric frame 100 enables the fabric 180 to be stretched tightly against all four rails 102-108 of the fabric frame 100. In particular, the fabric 180 may be stretched tightly in straight lines against upper surfaces of the left side rail 102, the right side rail 104, and the front rail 106, while at the same time being stretched tightly in a straight line against a lower surface of the rear rail 108.

Once the fabric 180 is mounted on the hoop frame configuration of the fabric frame 100 with an adequate tension, as disclosed in FIG. 1B, a user may grasp the handlebars 158 or the handlebars 160 and maneuver the sewing machine 150 laterally and longitudinally or some combination thereof, as discussed above, in order to cause the needle 156, in combination with the hopping foot 162, to form even and precisely positioned rows of stitches in the fabric 180 anywhere within the working area 118 of the fabric frame 100. In addition, even though the fabric frame 100 may have relatively small dimensions, such as about 5 feet wide (e.g., about 5 feet in the x dimension) by about 3 feet deep (e.g., about 3 feet in the x dimension), and thus be sized to fit in a relatively small room, the hoop frame configuration of the fabric frame 100 may be configured to accommodate fabric 180 that is relatively large, such as fabric 180 that is about 8.2 feet wide by about 8.5 feet long that is designed to be quilted into a quilt for a California king-sized bed.

As disclosed in FIGS. 1C and 1D, the fabric frame 100 may be configured to support one or more layers of the fabric 190 mounted thereon in a suspension frame configuration. While the suspension frame configuration of FIGS. 1C and 1D requires that the fabric 190 be generally narrower than the general width of the fabric frame 100, the suspension frame configuration of the fabric frame 100 may be configured to provide even more tension to the fabric 190 than the adequate tension provided by the hoop frame configuration of FIG. 1B. In particular, the fabric frame 100 may include a quilt-backing pole 126 including a ratchet mechanism 130 and a take-up pole 128 including a ratchet mechanism 132. In some embodiments, the quilt-backing pole 126 and take-up pole 128 may be added to the fabric frame 100, as an add-on feature for example (e.g., that may be added by bolting on the four brackets disclosed in FIG. 1A, for example), to convert the fabric frame 100 into a dual-configuration fabric frame. In some embodiments, the lengths of the quilt-backing pole 126 and the take-up pole 128 (and/or the length of the rear rail 108) may be greater than the length of the front rail 106.

As disclosed in FIG. 1C, the quilt-backing pole 126 and the take-up pole 128 may be configured to support the fabric 190 in such a way that the fabric 190 may flow from being spooled on the quilt-backing pole 126, past (e.g., over) the front rail 106, through the working area 118 between the left side boundary 110 and the right side boundary 112, and past (e.g., underneath) the rear rail 108, to being spooled on the take-up pole 128. While the fabric 190 is thus mounted in the suspension frame configuration, the ratchet mechanisms 130 and 132 of the quilt-backing pole 126 and the take-up pole 128 may be configured to maintain more than adequate tension on the fabric 190.

Alternatively, as disclosed in FIG. 1D, the quilt-backing pole 126 and the take-up pole 128 may be configured to support the fabric 190 in such a way that only a quilt-backing layer 192 of the fabric 190 is spooled on the quilt-backing pole 126, while a batting layer 194 and a quilt-top layer 196 of the fabric 190 are "floated" on top of the quilt-backing layer 192, which may include the batting layer 194 and the quilt-top layer 196 being draped over the quilt-backing layer 192 that is spooled on the quilt-backing pole 126. Then, similarly to the mounting in FIG. 1C, the three layers of the fabric 190 may flow past (e.g., over) the front rail 106, through the working area 118 between the left side boundary 110 and the right side boundary 112, and past (e.g., underneath) the rear rail 108, to being spooled on the take-up pole 128. In this embodiment, clamps (such as clamps 182) may further be employed to clamp the "floating" batting layer 194 and the "floating" quilt-top layer 196 to the front rail 106 to provide tension to these two "floating" layers. While the fabric 190 is thus mounted in the suspension frame configuration, the ratchet mechanisms 130 and 132 of the quilt-backing pole 126 and the take-up pole 128 may be configured to maintain more than adequate tension on the quilt-backing layer 192 of the fabric 190.

With reference to FIGS. 1A, 1C, and 1D, the fabric 190 may be mounted on the suspension frame configuration of the fabric frame 100 using a variety of mounting methods. One such mounting method may include various steps. For example, the method may include spooling the fabric 190 (which may include the quilt-backing layer 192, the batting layer 194 and the quilt-top layer 196) on the quilt-backing pole 126, as disclosed in FIG. 1C. Alternatively, the method may include spooling the quilt-backing layer 192 on the quilt-backing pole 126, and then "floating" the batting layer 194 and the quilt-top layer 196, which may include the batting layer 194 and the quilt-top layer 196 being draped over the quilt-backing pole 126, as disclosed in FIG. 1D. In either case, the method may then include flowing the fabric 190 over the front rail 106 and underneath the rear rail 108, and then spooling the fabric 190 on the take-up pole 128.

Next, the method may include pulling the fabric 190 tight on the fabric frame 100 using the ratchet mechanisms 130 and 132 in order to maintain a more than adequate tension on the fabric 190 (or at least the quilt-backing layer 192 of the fabric 190) during operation of the sewing machine 150. Further, in the embodiment disclosed in FIG. 1D, the method may further include clamping the batting layer 194 and the quilt-top layer 196 to the front rail 106. It is noted that this example method of mounting the fabric 190 to the fabric frame 100 enables the fabric 190 (or at least the quilt-backing layer 192 of the fabric 190) to be stretched tightly against the front rail 106 and the rear rail 108 of the fabric frame 100. In particular, the fabric 190 (or at least the quilt-backing layer 192 of the fabric 190) may be stretched tightly in a straight line against an upper surface of the front rail 106, while at the same time being stretched tightly in a straight line against a lower surface of the rear rail 108.

Once the fabric 190 is mounted on the suspension frame configuration of the fabric frame 100 with a more than adequate tension, as disclosed in FIGS. 1C and 1D, a user may grasp the handlebars 158 or the handlebars 160 and maneuver the sewing machine 150 laterally and longitudinally or some combination thereof, as discussed above, in order to cause the needle 156, in combination with the hopping foot 162, to form even and precisely positioned rows of stitches in the fabric 190 anywhere within the working area 118 of the fabric frame 100. In some embodiments, mounting the fabric 190 on the suspension frame configuration of FIGS. 1C and 1D may require less basting together of quilt layers than when mounting the fabric 180 on the hoop frame configuration of FIG. 1B.

Various alterations to the fabric frame 100 as disclosed in FIGS. 1A-1D are possible and contemplated. For example, instead of smooth, cylindrical outer surfaces, the left side rail 102, the right side rail 104, the front rail 106, and the rear rail 108 may have non-cylindrical outer surfaces, such as surfaces that include grooves or other features with which clamps may more easily or more durably engage. Additionally or alternatively, instead of the left side rail 102, the right side rail 104, and the front rail 106 being fixed in place, any or all of the left side rail 102, the right side rail 104, the front rail 106, and the rear rail 108 may be configured to rotate, such as being configured to rotate away from the working area 118 to increase the tension of the fabric 180 that is clamped thereto. Additionally or alternatively, instead of the rear rail 108 being positioned above the left side rail 102, the right side rail 104, and the front rail 106, the rear rail 108 may be positioned at about the same height as the other three rails, and be permanently connected to the other three rails (e.g., the clamps 124 may be omitted), with upper surfaces of all four of these rails forming a plane (corresponding to the working area 118 in FIGS. 1A-1D). In embodiments where upper surfaces of these four rails form a plane, the fabric 180 of FIG. 1B and the fabric 190 of FIGS. 1C and 1D may flow over the rear rail instead of under the rear rail, in which case the take-up pole 128 may be positioned beneath the plane instead of above the plane, while in either case the quilt-backing pole may remain positioned beneath the plane. Therefore, the hoop frame configuration disclosed in FIG. 1B and the suspension frame configuration disclosed in FIGS. 1C and 1D of the fabric frame 100 are not limited to the configurations disclosed in FIGS. 1A-1D.

All examples and conditional language recited herein are intended for pedagogical objects to aid the reader in understanding the example embodiments and the concepts contributed by the inventor to furthering the art, and are to be construed as being without limitation to such specifically-recited examples and conditions.

The invention claimed is:

1. A dual-configuration fabric frame for a maneuverable sewing machine, the dual-configuration fabric frame comprising:

a left side rail;

a right side rail;

a front rail;

a rear rail;

a quilt-backing pole including a ratchet mechanism;

a take-up pole including a ratchet mechanism;

a hoop frame configuration where the left side rail, the right side rail, the front rail, and the rear rail define a left side boundary, a right side boundary, a front boundary, and a rear boundary, respectively, of a working area, and where the left side rail, the right side rail, the front rail, and the rear rail are configured to support a relatively wide fabric clamped thereto that flows from inside the boundaries of the working area to outside the boundaries of the working area; and a suspension frame configuration where the ratchet mechanisms of the quilt-backing pole and the take-up pole are configured to maintain tension on a relatively narrow fabric that flows from being spooled on the quilt-backing pole, through the working area between the left side boundary and the right side boundary, to being spooled on the take-up pole.

2. The dual-configuration fabric frame of claim 1, wherein the left side rail, the right side rail, and the front rail are fixed in place and are not configured to rotate.

3. The dual-configuration fabric frame of claim 1, wherein the suspension frame configuration includes the ratchet mechanisms of the quilt-backing pole and the take-up pole being configured to maintain tension on the relatively narrow fabric that flows from being spooled on the quilt-backing pole, over the front rail, through the working area between the left side boundary and the right side boundary, and underneath the rear rail, to being spooled on the take-up pole.

4. The dual-configuration fabric frame of claim 1, wherein the left side rail, the right side rail, the front rail, and the rear rail have a smooth, cylindrical outer surface.

5. The dual-configuration fabric frame of claim 1, wherein the hoop frame configuration includes the left side rail, the right side rail, the front rail, and the rear rail being configured to support the relatively wide fabric clamped thereto that flows from inside the boundaries of the working area, underneath the rear rail, to outside the rear boundary of the working area.

6. The dual-configuration fabric frame of claim 5, wherein:

the dual-configuration fabric frame further comprises a left side clamp permanently connected to the left side rail;

the dual-configuration fabric frame further comprises a right side clamp permanently connected to the right side rail; and the rear rail is detachably connectable to the left side rail and the right side rail by clamping the rear rail in the left side clamp and the right side clamp.

7. The dual-configuration fabric frame of claim 1, wherein the length of the rear rail is greater than the length of the front rail.

8. The dual-configuration fabric frame of claim 1, wherein:

the length of the quilt-backing pole is greater than the length of the front rail; and the length of the take-up pole is greater than the length of the front rail.

9. The dual-configuration fabric frame of claim 1, wherein the left side rail, the right side rail, the front rail, and the rear rail are configured to rotate.

10. The dual-configuration fabric frame of claim 1, wherein the suspension frame configuration includes the ratchet mechanisms of the quilt-backing pole and the take-up pole being configured to maintain tension on the relatively narrow fabric that flows from being spooled on the quilt-backing pole, over the front rail, through the working area between the left side boundary and the right side boundary, and over the rear rail, to being spooled on the take-up pole.

11. The dual-configuration fabric frame of claim 1, wherein the left side rail, the right side rail, the front rail, and the rear rail have a non-cylindrical outer surface.

12. A dual-configuration fabric frame for a maneuverable sewing machine, the dual-configuration fabric frame comprising:

a left side rail having an upper surface;

a right side rail having an upper surface;

a front rail having an upper surface, the upper surfaces of the left side rail, the right side rail, and the front rail defining a plane;

a rear rail;

a quilt-backing pole including a ratchet mechanism and positioned beneath the plane;

a take-up pole including a ratchet mechanism;

a hoop frame configuration where the left side rail, the right side rail, the front rail, and the rear rail define a left side boundary, a right side boundary, a front boundary, and a rear boundary, respectively, of a working area, and where the left side rail, the right side rail, the front rail, and the rear rail are configured to support a relatively wide fabric clamped thereto that flows from inside the boundaries of the working area to outside the boundaries of the working area; and a suspension frame configuration where the ratchet mechanisms of the quilt-backing pole and the take-up pole are configured to maintain tension on a relatively narrow fabric that flows from being spooled on the quilt-backing pole, past by the front rail, through the working area between the left side boundary and the right side boundary, and past by the rear rail, to being spooled on the take-up pole.

13. The dual-configuration fabric frame of claim 12, wherein the left side rail, the right side rail, and the front rail are fixed in place and are not configured to rotate.

14. The dual-configuration fabric frame of claim 12, wherein:

the rear rail is positioned above the plane;

the take-up pole is positioned above the plane; and the suspension frame configuration includes the ratchet mechanisms of the quilt-backing pole and the take-up pole being configured to maintain tension on the relatively narrow fabric that flows from being spooled on the quilt-backing pole, over the front rail, through the working area between the left side boundary and the right side boundary, and underneath the rear rail, to being spooled on the take-up pole.

15. The dual-configuration fabric frame of claim 12, wherein the left side rail, the right side rail, the front rail, and the rear rail have a smooth, cylindrical outer surface.

16. The dual-configuration fabric frame of claim 12, wherein:

the length of the rear rail is greater than the length of the front rail;

the length of the quilt-backing pole is greater than the length of the front rail; and the length of the take-up pole is greater than the length of the front rail.

17. The dual-configuration fabric frame of claim 12, wherein the hoop frame configuration includes the left side rail, the right side rail, the front rail, and the rear rail being configured to support the relatively wide fabric clamped thereto that flows from inside the boundaries of the working area, underneath the rear rail, to outside the rear boundary of the working area.

18. The dual-configuration fabric frame of claim 12, wherein the left side rail, the right side rail, the front rail, and the rear rail are configured to rotate.

19. The dual-configuration fabric frame of claim 12, wherein:

the rear rail has an upper surface;

the upper surface of the rear rail further defines the plane;

the take-up pole is positioned below the plane; and the suspension frame configuration includes the ratchet mechanisms of the quilt-backing pole and the take-up pole being configured to maintain tension on the relatively narrow fabric that flows from being spooled on the quilt-backing pole, over the front rail, through the working area between the left side boundary and the right side boundary, and over the rear rail, to being spooled on the take-up pole.

20. The dual-configuration fabric frame of claim 12, wherein the left side rail, the right side rail, the front rail, and the rear rail have a non-cylindrical outer surface.

21. The dual-configuration fabric frame of claim 1, wherein the dual-configuration fabric frame is configured to be employed either in the hoop frame configuration or in the suspension frame configuration.

22. The dual-configuration fabric frame of claim 12, wherein the dual-configuration fabric frame is configured to be employed either in the hoop frame configuration or in the suspension frame configuration.

* * * * *